US006866449B2

(12) United States Patent
Riddiough

(10) Patent No.: US 6,866,449 B2
(45) Date of Patent: Mar. 15, 2005

(54) ANCHOR BLOCK CONSTRUCTION FOR AN ESCAPE LINE

(76) Inventor: Kevin Riddiough, Box 863, Rimbey, Alberta (CA), T0C 2J0

( * ) Notice: Subject to any disclaimer, the term of this patent is extended or adjusted under 35 U.S.C. 154(b) by 0 days.

(21) Appl. No.: 10/400,120

(22) Filed: Mar. 26, 2003

(65) Prior Publication Data

US 2004/0191001 A1 Sep. 30, 2004

(51) Int. Cl.[7] ..... B63B 21/24
(52) U.S. Cl. ..... 405/224; 114/293
(58) Field of Search ..... 405/229; 52/125.4, 52/125.5, 125.6, 125.2, 299; 114/293, 294, 295

(56) References Cited

U.S. PATENT DOCUMENTS

| | | | | |
|---|---|---|---|---|
| 1,549,356 A | * | 8/1925 | Goldbeck | 52/156 |
| 3,494,587 A | | 2/1970 | Kuhn | 248/361 |
| 3,643,446 A | * | 2/1972 | Mott | 405/202 |
| 3,695,207 A | * | 10/1972 | Atlas | 114/294 |
| 3,712,260 A | * | 1/1973 | Mott et al. | 114/230.13 |
| 3,969,901 A | * | 7/1976 | Matsudaira et al. | 405/23 |
| 4,018,015 A | | 4/1977 | Swanson | 52/23 |
| 4,056,944 A | * | 11/1977 | Lamy | 405/170 |
| 4,687,377 A | * | 8/1987 | Langner | 405/169 |
| 4,776,140 A | * | 10/1988 | Wight et al. | 52/125.5 |
| 5,040,924 A | | 8/1991 | Kothman | 405/244 |
| 5,337,534 A | | 8/1994 | Nasca | 52/745.21 |
| 5,619,951 A | * | 4/1997 | Constantinis | 114/365 |
| 5,750,894 A | * | 5/1998 | Russell et al. | 73/581 |
| 6,098,932 A | | 8/2000 | Olesen | 248/65 |
| 6,138,975 A | | 10/2000 | McDaid | 248/499 |
| 6,557,818 B2 | * | 5/2003 | Manthci | 249/171 |

FOREIGN PATENT DOCUMENTS

JP 2002322624 A * 11/2002 ..... E01F/15/02

* cited by examiner

*Primary Examiner*—Frederick L. Lagman
*Assistant Examiner*—Lisa M. Saldano
(74) *Attorney, Agent, or Firm*—Sturm & Fix LLP

(57) ABSTRACT

An anchor block construction (10) for attachment to an escape line (100) extending from a drilling rig (101) wherein, the construction (10) includes a concrete block member (20) having a base (21) with a plurality of downwardly depending anchor leg members (30), at least two inwardly angled sidewalls (22) (24) provided with anchor rod members (40) (40) disposed in recessed receptacle elements (50) and a top surface (26) likewise provided with an anchor rod member (40') disposed in a recessed receptacle (50) wherein, the escape line (100) is intended to be secured to a selected one of the sidewall anchor rod members (40)(40) which is disposed beneath the midline of the concrete block member (20).

6 Claims, 3 Drawing Sheets

ANCHOR BLOCK CONSTRUCTION FOR AN ESCAPE LINE

BACKGROUND OF THE INVENTION

Cross Reference to Related Applications

Not applicable.

1. Field of the Invention

The present invention relates to the field of tie down or anchoring devices in general and in particular to an anchor block construction for use in granular type soils to secure one end of an auxiliary escape line.

2. Description of Related Art

As can be seen by reference to the following U.S. Pat. Nos. 2,494,587; 5,040,924; 6,138,975; 4,018,015, and, 5,337,534, the prior art is replete with myriad and diverse anchor constructions used for a variety of different purposes.

While all of the aforementioned prior art constructions are more than adequate for the basic purpose and function for which they have been specifically designed, they are uniformly deficient with respect to their failure to provide a simple, efficient, and practical heavy duty anchor block construction for an escape line used to evacuate an oil field derrick or other elevated structure under emergency conditions.

As anyone who has spent any time around oil and gas drilling rigs is aware, there are occasions when it is imperative to quickly evacuate personnel from the immediate vicinity of a drilling rig and the current method of driving elongated steel anchor rods or pins into the soil and threading an anchor line through an eyelet in the anchor pin has proven to be less than satisfactory on more than one occasion.

As a consequence of the foregoing situation, there has existed a longstanding need in the drilling industry for a new and improved anchor block construction for drilling rig escape line anchors that will provide a stable immovable anchor for use in emergencies and the provision of such a stable, reliable construction is the stated objective of the present invention.

BRIEF SUMMARY OF THE INVENTION

Briefly stated, the anchor block construction that forms the basis of the present invention comprises in general a contoured concrete block member provided with a plurality of downwardly projecting leg members and a lesser plurality of anchor rods arranged in a generally triangular pattern and held in place within the concrete block member by at least a pair of closed loop cable ties.

As will be explained in greater detail further on in the specification, the concrete block member is formed from a pre-cast concrete block having a base, a plurality of angled side walls, and a top surface wherein, the anchor rods are disposed in arcuate recesses formed in a pair of the angled sidewalls and the top surface of the concrete block member.

In addition, each of the anchor leg members extends downwardly from the base of the block member and is further provided on its upper embedded ends with horizontally disposed metal plate elements that act as bearing surfaces, and the opposite ends of the anchor rods are likewise provided with metal plate element to prevent the lateral displacement of the anchor rods within the cast concrete block member wherein, the side anchor rods are adapted to be attached to an anchor line and the top anchor rod is provided for transporting the anchor block construction to a desired location.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
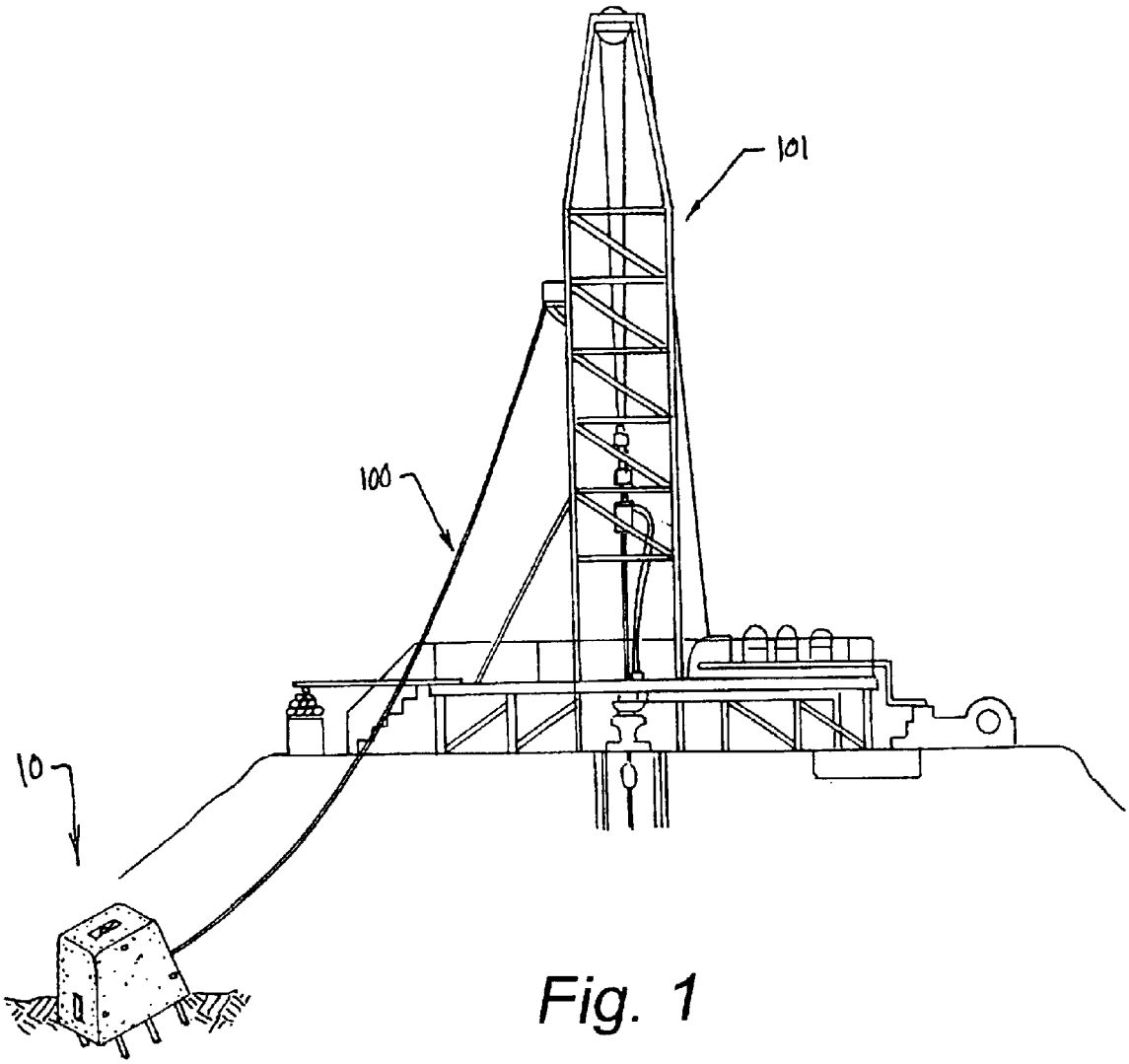
FIG. 1 is a perspective view of the environment in which the anchor block construction of this invention is employed.
Figure 5:
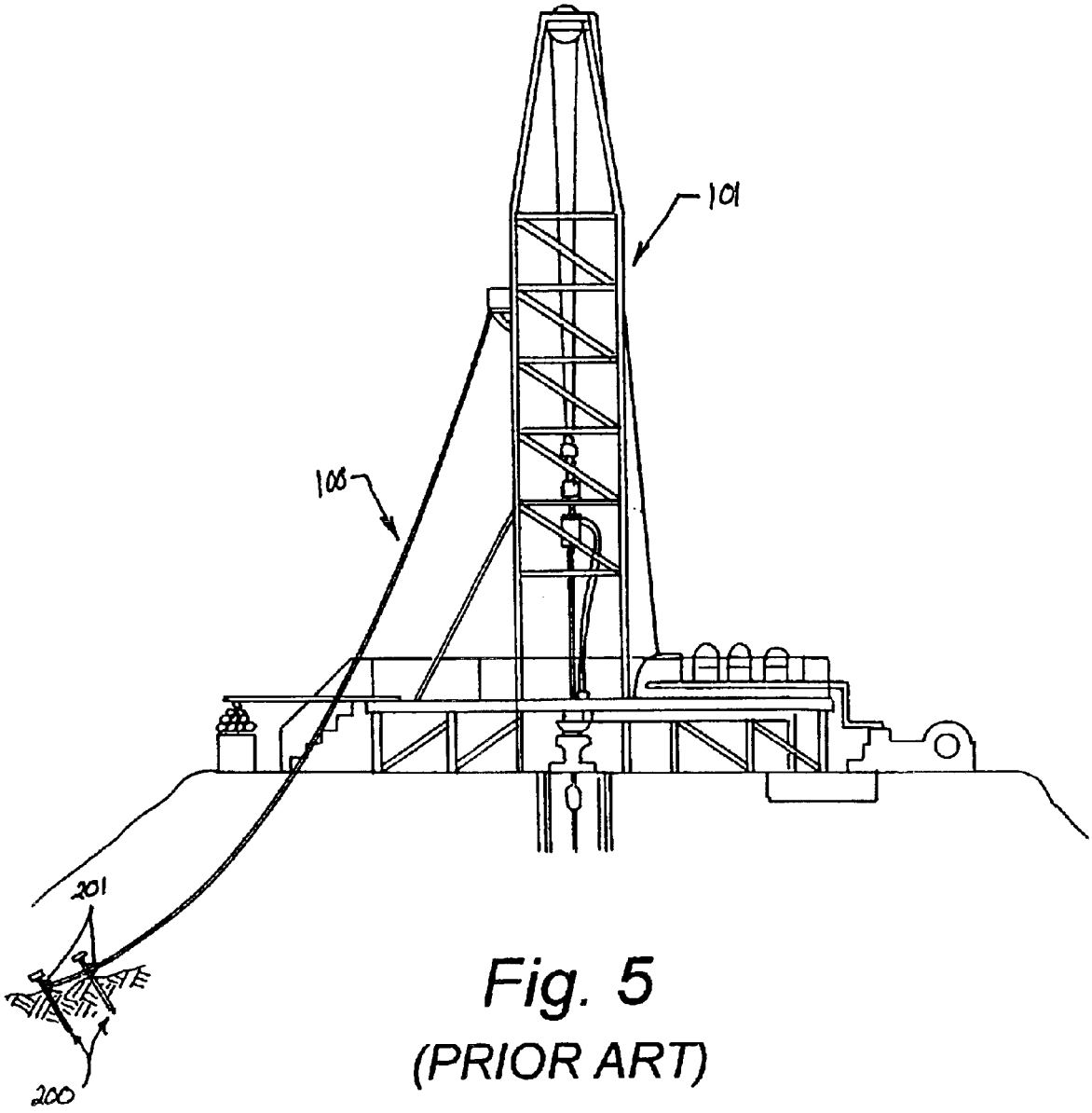
Fig. 5 (PRIOR ART)
FIG. 5 is a perspective view of the prior art arrangement currently employed to anchor escape lines from a drilling rig.

As can be seen by reference to the drawings, and in particular to FIG. 1, the anchor block construction that forms the basis of the present invention is designated generally by the reference number 10. FIG. 5, on the other hand, represents the current method of anchoring escape lines 100 from a drilling rig 101 by driving elongated metal pins 200 having an eyelet 201 into the soil and then threading the escape line 100 through the eyelets 201 to secure the lower end of the escape line 100 at a distance from the drilling rig 101. Unfortunately, as was mentioned previously, these anchor pins 200 are subject to failure in a number of ways, the most prevalent being the forcible extraction of the pins 200 from the soil under a weight bearing load being suspended from and traveling down the length of the escape line 100.

Figure 2:
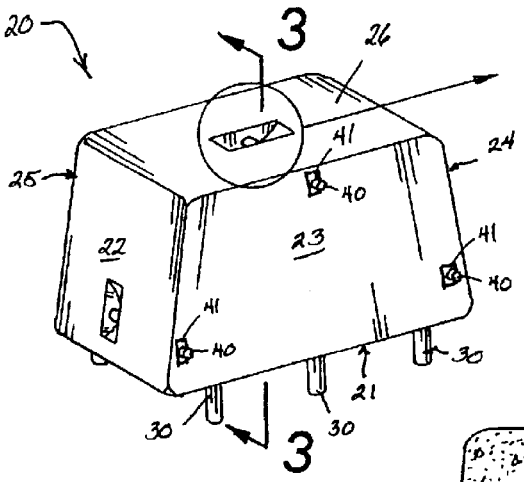
FIG. 2 is an enlarged perspective view of the anchor rod hardware and tensioning components.
Figure 2:
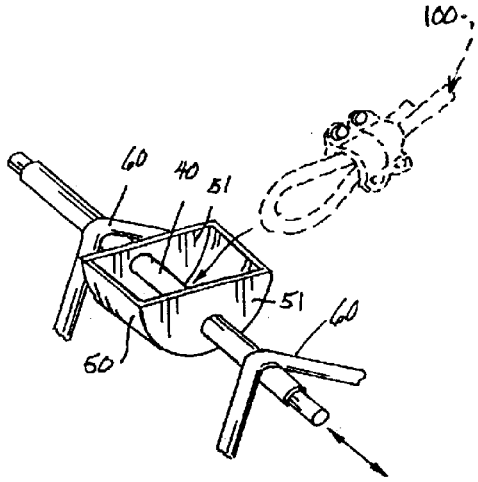
Figure 3:
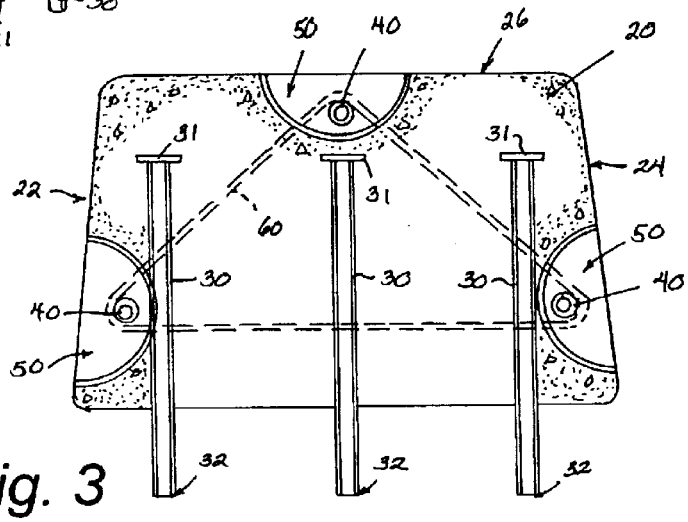
FIG. 3 is a cross-sectional view taken through line 3—3 of FIG. 2.
Figure 4:
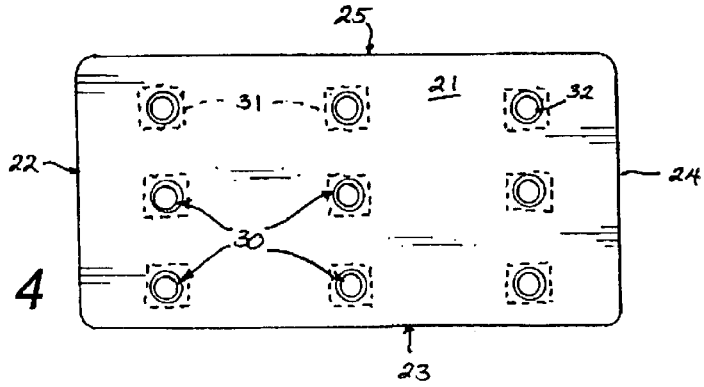
FIG. 4 is a bottom plan view of the anchor block construction.

Turning now to FIGS. 2 through 4, it can be seen that the anchor block construction 10 of this invention comprises a contoured pre-cast concrete block member 20 that includes an elongated rectangular base 21, a plurality of inwardly angled sidewalls 22 through 25, and a top surface 26.

In addition, as can best be seen by reference to FIGS. 3 and 4, the concrete block member 20 is further provided with a plurality of generally cylindrical anchor members 30 substantially embedded within the concrete block member 20 wherein, the upper ends of the anchor members 30 are provided with metal plate elements 31 that form weight bearing surfaces, and wherein, the lower ends 32 of each anchor member 30 extends downwardly from the base 21 of the block member 20 to penetrate the soil.

As can best be appreciated by reference to FIGS. 2 and 3, the block member 20 has a pair of horizontally elongated sides 23 25 and a pair of vertically elongated sides 22 24 wherein, both the vertically elongated sides 22 24 and the top surface 26 are each provided with a secured anchor rod member 40.

Still referring to FIGS. 2 and 3, it can be seen that the central portion of each of the anchor rod members 40 passes through the semi-circular, flat sidewalls 51 51 of a curved receptacle element 50 that is recessed into the opposed sides 22 24 and top surface 26 of the block member 20 wherein, the opposed ends of each anchor rod member 40 is provided with metal plate elements 41 to prevent the lateral displacement of the anchor rod members 40 relative to the concrete block member 20.

As can also be seen by reference to FIGS. 2 and 3, the anchor rod members 40 are operatively associated with one another via a pair of closed loop cable ties 60 60 that are embedded within the interior of the concrete block member 20 and arranged in a generally triangular configuration to distribute the weight of the block member 20 evenly about the upper anchor rod member 40' when the block member 20 is being transported to a desired location.

Turning now to FIGS. 1 through 3, it can be appreciated that in use, the concrete block member 20 is transported by the upper anchor rod member 40' to a desired location proximate to but spaced from a drilling rig 101 and the weight of the block member 20 will cause the anchor leg members 30 to penetrate the soil beneath the block member 20.

At this juncture, the escape line 100 is attached to a selected one of the side anchor rod members 40 which, it should be noted, is disposed beneath the midline of the concrete bock member 20 such that the weight of the concrete block member 20 and the penetrating engagement of the anchor-leg members 30 produce an approximately 1:1 resistance ratio between the weight of the block member and the amount of tension exerted on the escape line 100 disposed at an angle of 2:1 horizontal to vertical.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An anchor block construction for attachment to an escape line extending from a drilling rig wherein, the anchor construction comprises:

a concrete block member having a base, four sidewalls, and a top surface;

a plurality of anchor members each having an upper end embedded within the concrete block member and a lower end depending below the base of the block member; and, at least one anchor rod member disposed transversely in a recess formed in one of the sidewalls of the concrete block member, and another anchor rod member disposed transversely in a recess formed in the top surface of the concrete block member.

2. The construction as in claim 1; wherein, at least two of the sidewalls of the block member are inwardly angled.

3. The construction as in claim 1; wherein, said at least one anchor rod member and said another anchor rod member are operatively engaged by a pair of loop cable ties.

4. The construction as in claim 3; wherein, said pair of closed loop cable ties are offset from the recess formed in one of the sidewalls and the recess formed in the top surface of the concrete block member.

5. The construction as in claim 4; wherein, the concrete block member has yet another recess formed in the other of the sidewalls of the concrete block member and yet another anchor rod member disposed transversely in said yet another recess.

6. The construction as in claim 5; wherein, said pair of closed loop cable ties are operatively engaged with all of said anchor rod members.

* * * * *